US006481979B2

(12) United States Patent
Huang et al.

(10) Patent No.: US 6,481,979 B2
(45) Date of Patent: Nov. 19, 2002

(54) LUBRICATION PASSAGE AND NOZZLE FOR SWASH PLATE TYPE COMPRESSOR

(75) Inventors: Yong Huang, Ann Arbor, MI (US); Mirza Qadir M. Baig, Inkster, MI (US); Guntis V. Strikis, Belleville, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/748,544

(22) Filed: Dec. 26, 2000

(65) Prior Publication Data

US 2002/0081214 A1 Jun. 27, 2002

(51) Int. Cl.[7] ..... F04B 1/12; F04B 27/08
(52) U.S. Cl. ..... 417/269; 417/222.2; 92/153
(58) Field of Search ..... 417/269, 270, 417/271, 222.2; 92/153, 156; 184/6.17

(56) References Cited

U.S. PATENT DOCUMENTS 1,847,418 A 3/1932 Steedman
2,583,583 A 1/1952 Mangan ..... 230/206
4,497,284 A * 2/1985 Schramm ..... 123/41.47
4,974,702 A * 12/1990 Yokomachi et al. ..... 184/1.67
5,009,286 A * 4/1991 Ikeda et al. ..... 184/6.17
5,269,193 A * 12/1993 Rabinow ..... 74/60
5,772,407 A * 6/1998 Kato et al. ..... 417/269
5,779,004 A * 7/1998 Hoshino et al. ..... 184/6.17
6,010,314 A * 1/2000 Kobayashi et al. ..... 417/222.2
6,174,140 B1 * 1/2001 Ota et al. ..... 417/222.2

FOREIGN PATENT DOCUMENTS

JP 56138471 A * 10/1981

* cited by examiner

*Primary Examiner*—Charles G. Freay
*Assistant Examiner*—Han L. Liu
(74) *Attorney, Agent, or Firm*—Scott Confer, Esq.

(57) ABSTRACT

A variable displacement swash plate type compressor which incorporates a lubrication passage formed in a cylinder block and crankcase, and a spray nozzle disposed at the crankcase end of the lubrication passage. The lubrication passage provides fluid communication between an oil sump and the spray nozzle, and the spray nozzle causes lubricating oil to be efficiently distributed as a fine mist or spray to the crank chamber. The lubrication passage and spray nozzle maximize the flow of refrigerant gas and lubricating oil to the crank chamber under all operating conditions providing cooling and lubrication to the internal moving components within the crankcase.

8 Claims, 2 Drawing Sheets

LUBRICATION PASSAGE AND NOZZLE FOR SWASH PLATE TYPE COMPRESSOR

FIELD OF THE INVENTION

The present invention relates to a variable displacement swash plate type compressor adapted for use in an air conditioning system for a vehicle, and more particularly to a compressor having a passage providing fluid communication between an oil sump and a crank chamber, and a spray nozzle disposed at the crank chamber end of the passage for efficiently distributing a fine mist or spray of lubricating oil to the crank chamber.

BACKGROUND OF THE INVENTION

A typical conventional variable displacement swash plate type compressor includes a cylinder block provided with a number of cylinders, a piston disposed in each of the cylinders of the cylinder block, a crankcase sealingly disposed on one end of the cylinder block, a cylinder head sealingly disposed on the other end of the cylinder block, a rotatably supported drive shaft, and a swash plate. The swash plate is adapted to be rotated by the drive shaft. Rotation of the swash plate is effective to reciprocatively drive the pistons. The length of the stroke of the pistons is varied by the inclination of the swash plate. Inclination of the swash plate is varied by controlling the pressure differential between a suction chamber and a crank chamber. Lubrication of components within the crankcase is typically provided by circulating refrigerant gas mixed with lubricating oil within the internal refrigerant circuit of the compressor. Typical conventional variable displacement swash plate type compressors may also use carbon dioxide (CO2) as the refrigerant gas.

Another conventional lubricating system disclosed in the prior art employs lubricating oil passageways separately arranged from the refrigeration circuits. The separately arranged oil passageways avoid reduction in the refrigerating efficiency of a refrigeration circuit in a vehicle caused by an attachment of the lubricating oil to an evaporator of an air conditioning system. For example, lubricating oil may be pumped by a gear pump through a lubrication passage and radial branch passageways within the drive shaft to lubricate the moving components within the crank chamber.

The compressor arrangements in the prior art described above in which CO2 is used as the refrigerant gas have several disadvantages. First, because conventional lubricating oil is not soluble in CO2, the lubricating oil cannot be effectively distributed with the CO2 as the CO2 is circulated within the internal refrigeration circuit, resulting in ineffective lubrication of the close tolerance moving parts within the crank chamber. Second, in a compressor having separately arranged lubrication passages, the lubricating oil is subjected to a gradual pressure drop while flowing inside the lubrication passages. The volume of the oil flowing out of the branch passageways furthest from the gear pump is caused to become less than the volume of oil flowing out of the branch passageways nearest the gear pump. In such an arrangement lubricating oil is not efficiently and effectively distributed within the crank chamber.

An object of the present invention is to produce a swash plate type compressor wherein oil flow to the crankcase during both minimum and maximum operating conditions is improved to result in efficient lubrication of the compressor components.

Another object of the present invention is to produce a swash plate type compressor wherein lubricating oil can be efficiently and evenly distributed within the crank chamber.

SUMMARY OF THE INVENTION

The above, as well as other objects of the invention, may be readily achieved by a variable displacement swash plate type compressor comprising: a cylinder block having a plurality of cylinders arranged radially therein; an oil sump for containing lubricating oil; a piston reciprocatively disposed in each of the cylinders of the cylinder block; a cylinder head attached to the cylinder block; a crankcase attached to the cylinder block to define a crank chamber; a drive shaft rotatably supported by the crankcase and the cylinder block; a swash plate adapted to be driven by the drive shaft, the swash plate having a central aperture for receiving the drive shaft; a pump for distributing the lubricating oil from the oil sump to the crank chamber; a lubrication passage providing fluid communication between the oil sump and the crank chamber; and a spray nozzle disposed at the crank chamber end of the lubrication passage for facilitating distribution of lubricating oil to the crank chamber.

BRIEF DESCRIPTION OF THE DRAWINGS

The above, as well as other objects, features, and advantages of the present invention will be understood from the following detailed description of the preferred embodiment of the present invention with reference to the accompanying drawings, in which.

DETAILED DESCRIPTION OF THE PREFERRED EMBODIMENT

Figure 1:
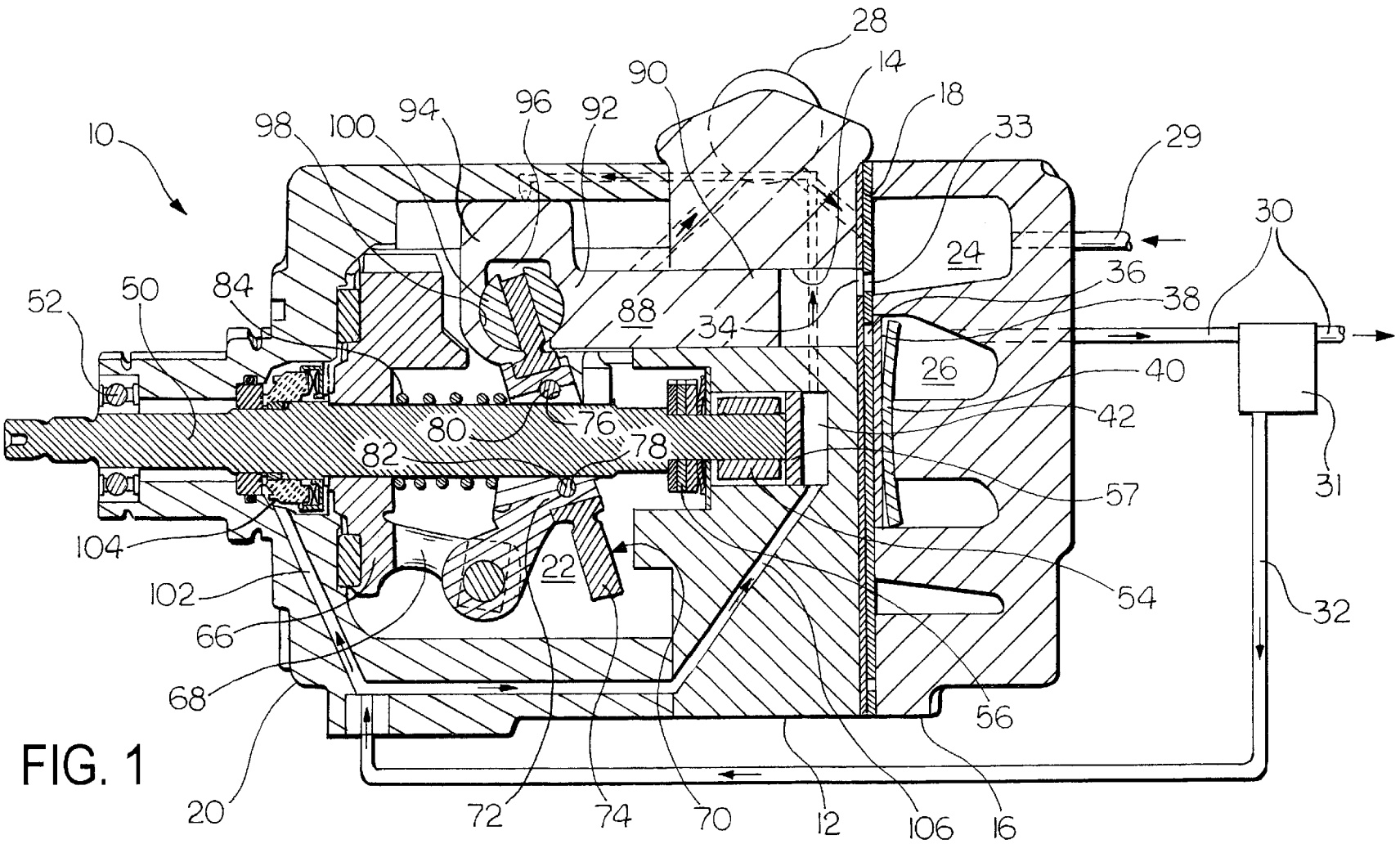
FIG. 1 is a cross sectional elevational view of a variable displacement swash plate type compressor incorporating the features of the invention, showing a lubrication passage in the cylinder block and the crankcase in fluid communication with the oil sump and the crank chamber, and a spray nozzle disposed at the crank chamber end of the lubrication passage.

Referring now to the drawings, and particularly FIG. 1, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a suction chamber 24 and a discharge chamber 26. A conduit 27 is disposed to provide fluid communication between the crank chamber 22 and the suction chamber 24. An electronic control valve 28 is disposed in the conduit 27 for controlling the flow of refrigerant gas from the crank chamber 22 to the suction chamber 24. The valve 28 can be of any conventional type such as, for example, a ball type valve. The valve 28 is designed to receive an electrical control signal from a remote microprocessor (not shown). The microprocessor monitors the discharge pressure of the compressor, the RPM of the vehicle engine, the cabin temperature and humidity, and the like, to control valve 28 which, in turn, controls the flow of refrigerant gas from the crank chamber 22 to the suction chamber 24. An inlet port 29 provides fluid communication between an evaporator (not shown) of the cooling portion of an air conditioning system for a vehicle and the suction chamber 24. An outlet conduit 30 provides fluid communication between the discharge chamber 26 and the cooling portion of the air conditioning system for a vehicle. An oil separator 31 is disposed in the conduit 30. An orifice tube 32 provides fluid communication between the oil separator 31 and the crank chamber 22.

Suction ports 33 provide fluid communication between the suction chamber 24 and each cylinder 14. Each suction port 33 is opened and closed by a flap valve 34 which may be formed as an integral part of the valve plate 18. Discharge ports 36 provide fluid communication between each cylinder 14 and the discharge chamber 26. Each discharge port 36 is opened and closed by a discharge valve 38. A retainer 40 restricts the opening of the discharge valve 38. An oil sump 42 is formed in the cylinder block 12.

A drive shaft 50 is centrally disposed in and arranged to extend through the crankcase 20 to the cylinder block 12. One end of the drive shaft 50 is rotatably supported by a bearing 52 mounted in the crankcase 20, and the other end of the drive shaft 50 is rotatably supported in a bearing 54 mounted in the cylinder block 12. Longitudinal movement of the drive shaft 50 is restricted by a thrust bearing 56 mounted in the cylinder block 12. A drive shaft driven gear pump 57 is disposed within the oil sump 42.

Figure 2:
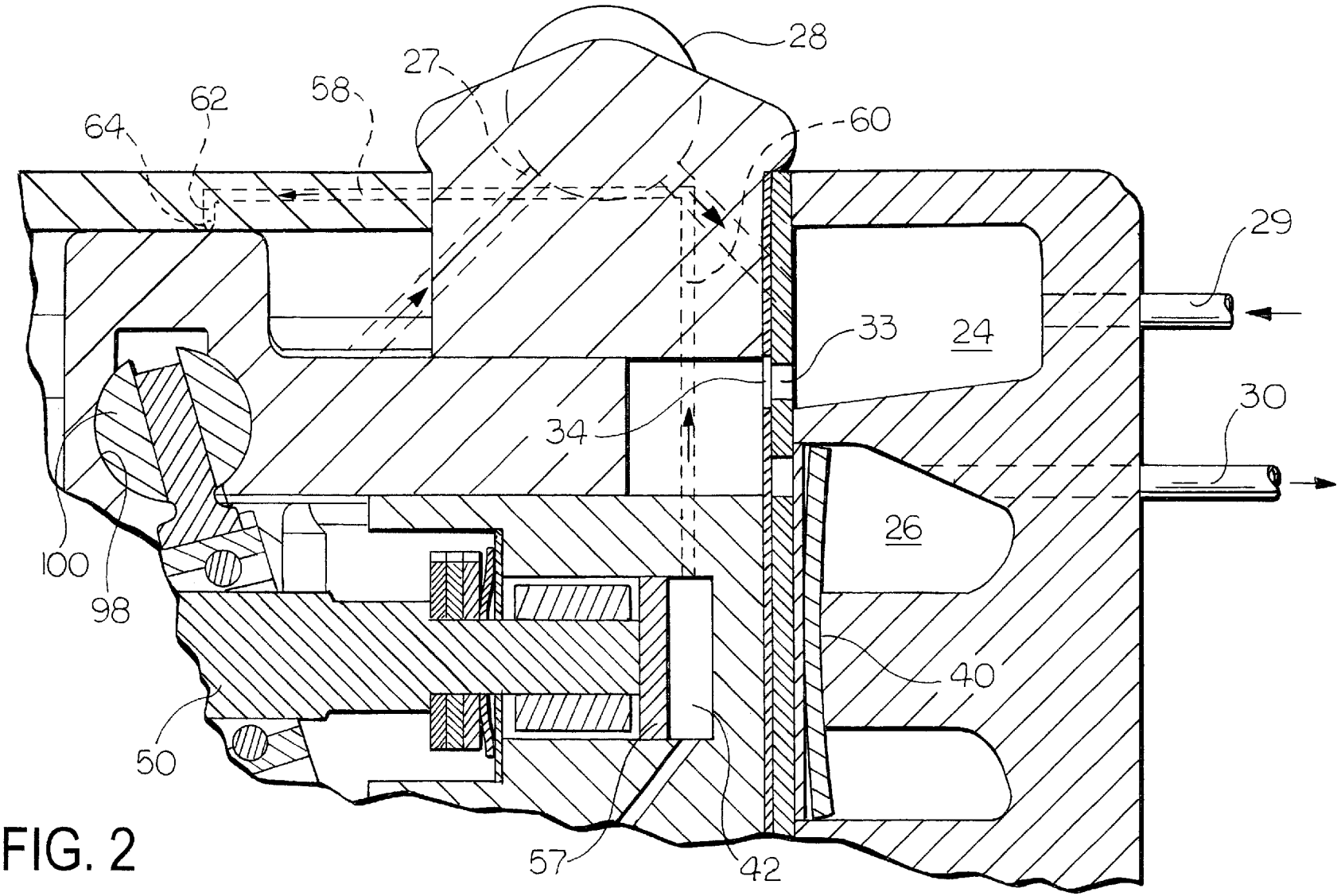
FIG. 2 is a fragmentary enlarged cross sectional view of the compressor illustrated in FIG. 1, a phantom line showing the features of the lubrication passage and nozzle of the invention.

Referring now to FIG. 2, a longitudinally extending lubrication passage or bore 58 is formed within the cylinder block 12 and the crankcase 20. The bore 58 communicates with radially extending bores 60, 62. Bore 62 includes a spray nozzle 64 having an orifice opening into the crank chamber 22. The lubrication passage 58 and the bores 60, 62 provide fluid communication between the oil sump 42 and the nozzle 64. The nozzle 64 is arranged to evenly distribute lubricating oil to the crank chamber 22. The nozzle 64 can be of any conventional type such as, for example, a nozzle in which the orifice has a smaller diameter than the diameter of the bore 62, and in which an internal vane causes controlled turbulence of the oil within the nozzle 64. Such a nozzle structure thereby causes the oil to be discharged through the orifice in a fine mist or spray.

A rotor 66 is fixedly mounted on an outer surface of the drive shaft 50 adjacent one end of the crankcase 20 within the crank chamber 22. An arm 68 extends outwardly from a surface of the rotor 66 opposite the surface of the rotor 66 that is adjacent the end of the crankcase 20.

A swash plate 70 is formed to include a hub 72 and an annular plate 74. The arm 68 is hingedly connected to the hub 72.

A pair of spaced apart holes 76, 78 are formed in the hub 72 and are adapted to receive pins 80, 82, respectively which are typically press fit therein. The outer surfaces of the pins 80, 82 are formed to extend inwardly within the hub 72.

The hub 72 is press fit in a suitable central aperture of the annular plate 74. In the assembled form the drive shaft 50 is adapted to extend through the central aperture of the hub 72.

A helical compression spring 84 is disposed to extend around the outer surface of the drive shaft 50. One end of the spring 84 abuts the rotor 66, while the opposite end abuts the hub 72 of the swash plate 70. The spring 84 tends to urge the swash plate 70 away from the rotor 66.

A piston 88 is slidably disposed in each of the cylinders 14 in the cylinder block 12. Each piston 88 includes a head 90, a middle portion 92, and a bridge portion 94. The middle portion 92 terminates in the bridge portion 94 defining an interior space 96 for receiving the annular plate 74. Spaced apart concave pockets 98 are formed in the interior space 96 of the bridge portion 94 for rotatably containing a pair of semi-spherical shoes 100. The spherical surfaces of the shoes 100 are disposed in the shoe pockets 98 with a flat bearing surface disposed opposite the spherical surface for slidable engagement with the opposing sides of the annular plate 74.

In operation, the compressor 10 is actuated by the rotation of the drive shaft 50 which is typically an associated internal combustion engine of a vehicle. Rotation of the drive shaft 50 causes the simultaneous rotation of the rotor 66. The hub 72 of the swash plate 70 is hingedly connected to the arm 68 of the rotor 66. Rotation of the rotor 66 causes the swash plate 70 to rotate. During rotation, the swash plate 70 is disposed at an inclination. The rotation of the swash plate 70 is effective to reciprocatively drive the pistons 88. The rotation of the swash plate 70 further causes a sliding engagement between the annular plate 74 and the cooperating spaced apart shoes 100.

The reciprocation of the pistons 88 causes refrigerant gas to be introduced from the suction chamber 24 into the respective cylinders 14 of the cylinder head 16. The reciprocating motion of the pistons 88 then compresses the refrigerant gas within each cylinder 14. When the pressure within each cylinder 14 reaches the pressure within the discharge chamber 26, the compressed refrigerant gas is discharged into the discharge chamber 26.

The capacity of the compressor 10 can be changed by changing the inclination of the swash plate 70 and thereby changing the length of the stroke for the pistons 88.

The valve 28 is arranged to monitor the suction and crank chamber pressures of the compressor 10, and control the flow of refrigerant gas from the crank chamber 22 to the suction chamber 24. When an increase in thermal load occurs, the valve 28 is caused to open, thereby causing refrigerant gas to flow through the valve 28 to the suction chamber 24. The pressure differential between the crank chamber 22 and the suction chamber 24 is then equalized. As a result of the decreased backpressure acting on the pistons 88 in the crank chamber 22, the swash plate 70 is moved against the force of the spring 84, the inclination of the swash plate 70 is increased, and as a result, the length of the stroke of each piston 88 is increased.

Conversely, when a decrease in thermal load occurs, the valve 28 is caused to close, thereby reducing the flow of refrigerant gas from the crank chamber 22 to the suction chamber 24. Because the flow of pressurized refrigerant gas to the crank chamber 22 from the discharge 26 is larger than the flow of refrigerant gas from the crank chamber 22 to the suction chamber 24, the backpressure acting on the pistons 88 in the crank chamber 22 is increased. As a result of the increased backpressure in the crank chamber 22, the swash plate 70 yields to the force of the spring 84, the inclination of the swash plate 70 is decreased, and as a result, the length of the stroke of each piston 88 is reduced.

Lubricating oil is introduced into the orifice tube 32 from the oil separator 31, and caused to flow through a passage 102 to a shaft seal 104, and through a passage 106 to the oil sump 42. Rotation of the drive shaft 50 causes the pump 57 to pump lubricating oil from the oil sump 42 into the passage 58. The pressurized lubricating oil within the passage 58 is caused to flow through the nozzle 64. The internal vane within the nozzle 64 causes controlled turbulence of the oil within the nozzle, thereby causing the oil to be evenly discharged into the crank chamber 22 in the form of a fine mist or spray.

By introducing lubricating oil from the oil sump 42 into the crank chamber 22 through the lubrication passage 58 and the nozzle 64 the lubricating efficiency of the compressor 10 is maximized. In the preferred embodiment of the invention, the flow of lubricating oil between the oil sump 42 and the crank chamber 22, through the lubrication passage 58 and nozzle 64 is provided during both minimum and maximum operating conditions of the compressor 10 by the drive shaft driven pump 57. The use of the nozzle 64 at the crank chamber 22 end of the passage 58 facilitates efficient and even distribution of lubricating oil into the crank chamber 22. The lubricating oil introduced into the crank chamber 22 through the passage 58 and the nozzle 64 provides lubrication to the close tolerance moving components within the crank chamber 22 such as bearings 56, the swash plate 70, the shoe pockets 98, and the shoes 100. The introduction of lubricating oil to the crank chamber 22 improves the durability of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable displacement swash plate type compressor comprising:

a cylinder block having a plurality of cylinders arranged radially therein;

an oil sump for containing lubricating oil;

a piston reciprocatively disposed in each of the cylinders of said cylinder block;

a cylinder head attached to said cylinder block, said cylinder head having an inlet and an outlet;

a crankcase attached to said cylinder block to define a crank chamber;

a drive shaft rotatably supported by said crankcase and said cylinder block;

a rotor fixedly mounted on said drive shaft;

a swash plate adapted to be driven by said rotor, said swash plate having a central aperture for receiving said drive shaft;

a hinge means disposed between said rotor and said swash plate to hingedly connect said rotor and said swash plate;

a pump for distributing the lubricating oil from said oil sump to the crank chamber;

a lubrication passage providing fluid communication between said oil sump and the crank chamber; and a spray nozzle disposed at the crank chamber end of said lubrication passage for facilitating distribution of lubricating oil to the crank chamber.

2. The compressor according to claim 1, wherein said oil sump is formed in said cylinder block.

3. The compressor according to claim 2, wherein said pump is a gear pump driven by said drive shaft.

4. The compressor according to claim 3, wherein said lubrication passage is formed within said cylinder block and said crankcase.

5. Lubrication means for a variable displacement swash plate type compressor, the compressor having a cylinder head, a cylinder block having an oil sump formed therein, a crankcase forming a crank chamber therein, an inlet and an outlet, and a plurality of pistons:

an oil separator adapted to be installed in the outlet of the compressor, said separator removing a lubricating oil from a refrigerant and supplying the oil to the oil sump;

a lubrication passage providing fluid communication between the oil sump and the crank chamber, said lubrication passage formed within the cylinder block and the crankcase; and a spray nozzle disposed at the crank chamber end of said lubrication passage for facilitating distribution of the lubricating oil to the crank chamber.

6. A variable displacement swash plate type compressor comprising:

a cylinder block having a plurality of cylinders arranged radially therein;

an oil sump for containing lubricating oil formed within said cylinder block;

a piston reciprocatively disposed in each of the cylinders of said cylinder block;

a cylinder head attached to said cylinder block and having a suction chamber and a discharge chamber formed therein;

a crankcase attached to said cylinder block and cooperating with said cylinder block to define a crank chamber;

a drive shaft rotatably supported by said crankcase and said cylinder block and adapted to be coupled to an auxiliary drive means;

a rotor fixedly mounted on said drive shaft;

a swash plate adapted to be driven by said drive shaft and having a central aperture for receiving said drive shaft, radially outwardly extending side walls, and a peripheral edge;

a gear pump for distributing the lubricating oil from said oil sump to the crank chamber, said gear pump driven by said drive shaft;

hinge means disposed between said rotor and said swash plate to hingedly connect said rotor and said swash plate;

a lubrication passage formed within said cylinder block and said crankcase providing fluid communication between said oil sump and the crank chamber; and a spray nozzle disposed at the crank chamber end of said lubrication passage for facilitating distribution of lubricating oil to the crank chamber.

7. The compressor according to claim 1, including an oil separator disposed in the outlet of said cylinder head, the separator removing the lubricating oil from a refrigerant and supplying the lubricating oil to said oil sump.

8. The compressor according to claim 7, wherein the refrigerant is $CO_2$.

* * * * *